United States Patent [19]

Komori et al.

[11] 3,994,257

[45] Nov. 30, 1976

[54] DEVELOPING DEVICE IN AN ELECTROPHOTOGRAPHIC COPYING APPARATUS

[75] Inventors: Shigehiro Komori, Yokohama; Hiroshi Nitanda; Toshihide Iida, both of Tokyo, all of Japan

[73] Assignee: Canon Kabushiki Kaisha, Tokyo, Japan

[22] Filed: Jan. 20, 1975

[21] Appl. No.: 542,584

Related U.S. Application Data

[63] Continuation of Ser. No. 315,467, Dec. 15, 1972, abandoned.

[52] U.S. Cl. .....118/7; 118/646

[51] Int. Cl.[2] ..... B05C 11/00

[58] Field of Search ..... 118/637, DIG. 23, 7; 427/15; 355/3 P, 1 E; 96/164

[56] References Cited

UNITED STATES PATENTS

| | | | |
|---|---|---|---|
| 3,369,524 | 2/1968 | Führer | 118/637 |
| 3,494,328 | 2/1970 | Maloney | 118/637 |
| 3,698,356 | 10/1972 | DuBois et al. | 118/DIG. 23 |
| 3,739,800 | 6/1973 | Aasen et al. | 118/DIG. 23 |
| 3,752,119 | 8/1973 | Matkan | 118/637 |

*Primary Examiner*—Ronald Feldbaum
*Attorney, Agent, or Firm*—Fitzpatrick, Cella, Harper & Scinto

[57] ABSTRACT

In an electrophotographic copying apparatus using developing liquid to develop an electrostatic latent image formed on the surface of an electrostatic image bearing member, a developing device comprises a developing liquid storage tank, a developing portion for contacting the electrostatic image bearing member with developing liquid, pumping means for supplying developing liquid from the storage tank to the developing portion, and means for controlling the density of the developing liquid.

1 Claim, 9 Drawing Figures

DEVELOPING DEVICE IN AN ELECTROPHOTOGRAPHIC COPYING APPARATUS

This is a continuation, of application Ser. No. 315,467, filed Dec. 15, 1972 now abandoned.

BACKGROUND OF THE INVENTION

1. Field of the Invention

This invention relates to a developing device in an electrophotographic copying apparatus of the liquid developing type, and more particularly to a developing device in which masses of toner present in developing liquid composed of carrier liquid and toner are dispersed to thereby maintain the toner density constant.

2. Description of the Prior Art

In electrophotographic copying machines, the liquid development has been superior to the dry type development in that the former is more efficient and can produce better copies than the latter. The developing liquid used therefore is composed of carrier liquid and toner, and the toner must be maintained uniformly dispersed to provide good image reproduction. Further, in view of the gradual toner consumption caused by the developing process, it is also necessary during a long-time use to detect the toner density at all times to maintain the developing liquid at a density adapted for the image to be copied.

For these purposes, it has heretofore been the practice to measure the density of the developing liquid by using photoelectric detector means comprising a lamp and a light receiving element. However, the photoelectric detector means simply immersed in the liquid within a developer container as was done in the prior art would readily permit deposition of toner which in turn would cause density differences in different parts of the liquid. In addition, the toner would often adhere to a transparent member interposed between the lamp and the light receiving element, thereby reducing the detecting function of the detector means. Also, in another conventional arrangement wherein the photoelectric detector means is disposed outwardly of the developer container and the developing liquid is supplied by a pump, the developing liquid rarely stays in the detector means during the inoperative condition of the apparatus so that the surface of the transparent member tends to dry up and permits residual toner to adhere thereto. For these and other reasons, it has been difficult with such arrangement to ensure accurate density detection and to provide image reproduction of constant and excellent quality by simply detecting the density and supplying a predetermined amount of toner.

Furthermore, the developing liquid tends to evaporate during the inoperative condition of the apparatus to readily cause the toner in the carrier liquid to adhere and solidify. When the apparatus is restarted, such solidified toner may be admixed with a circulating flow of developing liquid which is supplied to developing electrode means, thus causing irregular image reproduction to take place or injuries to be imparted to the photosensitive medium.

SUMMARY OF THE INVENTION

It is an object of the present invention to provide a developing device which overcomes the above-noted disadvantages and always ensures image reproduction of excellent quality.

It is another object of the present invention to provide a developing device which enables developing liquid of uniform and constant density to be supplied.

It is still another object of the present invention to provide a developing device which efficiently maintains the developing liquid at a uniform and constant density.

It is yet another object of the present invention to provide a developing device which can prevent its performance from being reduced due to contamination imparted by the adherence of the toner in the developing liquid.

Generally, the developing device according to the present invention is arranged such that developing liquid stored in a developer storage tank is supplied to a developing portion by pumping means to thereby develop an electrostatic latent image formed on the surface of an electrostatic image bearing member, the developing liquid being stirred continuously to maintain a uniform density in the storage tank. The stirring effect is also useful to uniformly disperse the portion of the developing liquid which was once used for the development process and collected for reuse, thus eliminating toner solidification and other unfavorable factors which would form hindrances to the image reproduction.

On the other hand, the density detector means is protected against contamination due to the adherence of toner and can always accurately detect the density of the developing liquid to maintain it at a constant density level. By these density control means, the developing device of the present invention enables image reproduction of excellent quality to be provided at all times.

BRIEF DESCRIPTION OF THE DRAWINGS

The invention will become fully apparent from the following detailed description thereof taken in conjunction with the accompanying drawings, in which.

DESCRIPTION OF THE PREFERRED EMBODIMENTS

Figure 1:
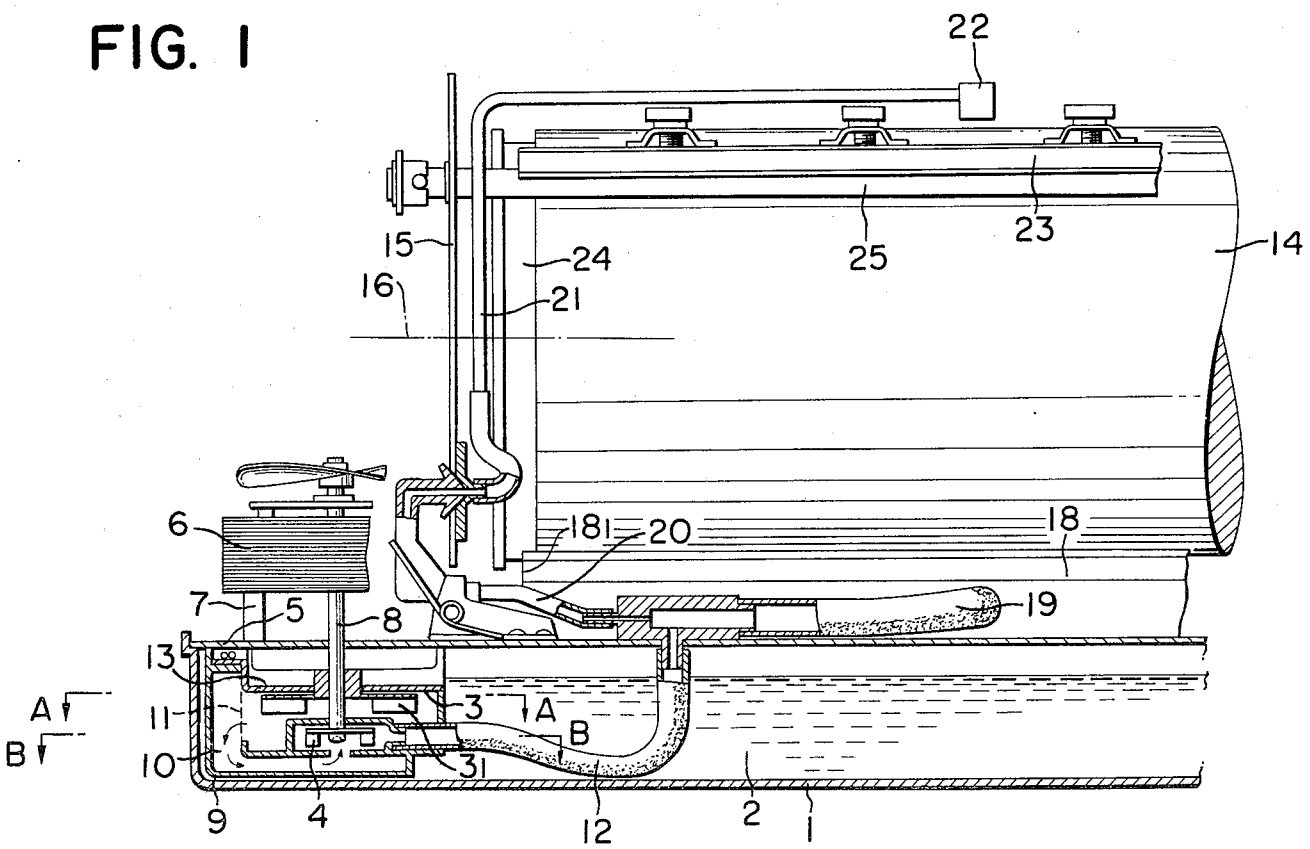
FIG. 1 is a vertical cross-section through a portion of a basic form of the developing device according to the present invention.

Referring to FIG. 1, there is shown an embodiment of the device according to the present invention, which includes a developer container 1 for storing developing liquid 2 therein, a stirring impeller 3 located within the developing liquid, a pump 4 located just below the stirring impeller 3, and a motor 6 mounted on the lid 5 of the container 1 by means of a strut 7. In the illustrated example, the stirring impeller 3 and the pump 4 are mounted on a common motor shaft 8. A frame 9 supports the stirring impeller 3 and pump 4 and is fixedly secured to the lid 5. An intake port 10 for the pump 4 is formed in the frame 9, and a filter 11 is provided across the entrance of the intake port 10 and faces the stirring impeller 3.

When rotated, the motor 6 drives the stirring impeller 3 and pump 4 so that the stirring blades $3_1$ produce a stirred flow therearound which circulates through the developer container 1 to agitate the toner deposited in the container while part of the said flow is sucked into the pump 4 through the filter 11 and intake port 10 and supplied via a pipe 12 to a developing portion.

Figure 2:
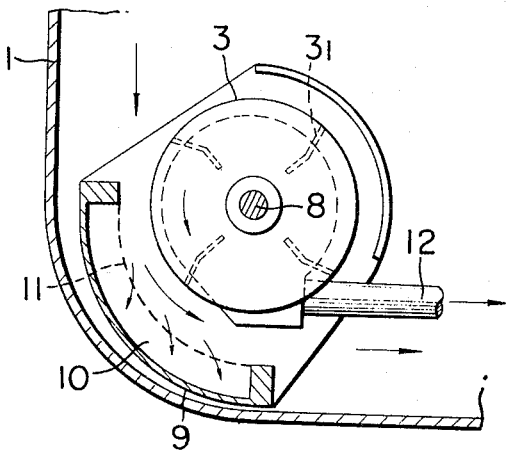
FIG. 2 is a plan view taken along line A—A in FIG. 1.

Referring to FIG. 2, which is a plan view taken along line A—A of FIG. 1, the stirring blades $3_1$ are substantially perpendicularly mounted on a rotating disk, which is fixedly mounted on a rotating shaft 8. An area formed by a phantom circle passing along the outer ends of all of the blades $3_1$ and a phantom circle passing along the inner ends of all of the blades $3_1$ forms a passage for the liquid. In greater detail, the liquid enters the impeller 3 through the outer phantom circle and then reaches the inner phantom circle, and thereafter, returns to the outer phantom circle, through which the liquid is discharged out of the impeller 3. Therefore, it will be seen that the rotation of the stirring impeller 3 causes a flow of liquid oriented laterally to the shaft 8 as indicated by arrows and, as required, the flow is directed so as to dually cross the path of the stirring blades $3_1$.

Figure 3:
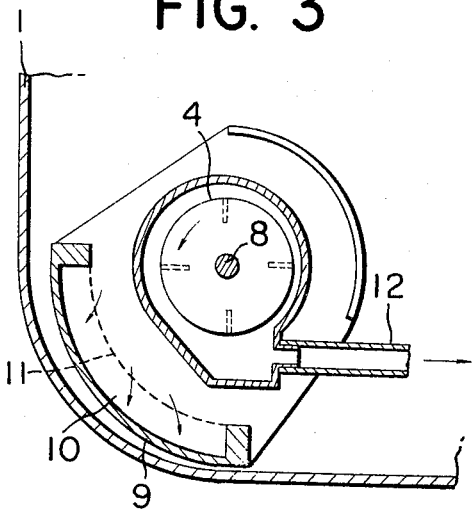
FIG. 3 is a plan view taken along line B—B in FIG. 1.

Reference is now had to FIG. 3, which is a plan view taken along line B—B of FIG. 1. The stirring impeller 3 stirs the toner deposited in the container as described previously, the toner being in the form of masses produced in the developing liquid in the described manner. These masses of toner are made to move as a stirred flow around the impeller 3 and to impinge on the filter 11 for re-dispersion, or to impinge on any masses of toner which might have already adhered to the filter, thus dispersing or displacing such earlier adhered toner masses to thereby prevent them from further adhering to the filter. The developing liquid is sucked into the pump 4 at a small rate while being filtrated through the filter 11 at the entrance of the intake port 10, so that only the toner free of masses is delivered to the developing part.

The residual liquid once used for development or the liquid used to clean the surface of the photosensitive drum 14 may be collected in the container 1 for reuse. Any dust or other foreign material which may be present in such liquid is filtered to protect the photosensitive medium against damage.

Since the pump 4 utilizes as its drive source a common motor with the stirring impeller, the former is desirably disposed just below the latter. The rapid rotation of the stirring impeller 3 which is in the range of 2,000 to 3,000 r.p.m. may cause air to be introduced into the liquid, thereby producing bubbles therein. If liquid with such bubbles is supplied, it would reduce the pumping efficiency and accordingly result in an uneven developing effect. For this reason, a partition plate 13 may preferably be provided just above the stirring impeller 3 to isolate the liquid from the air on the surface of the developing liquid (see FIG. 1).

Figure 4:
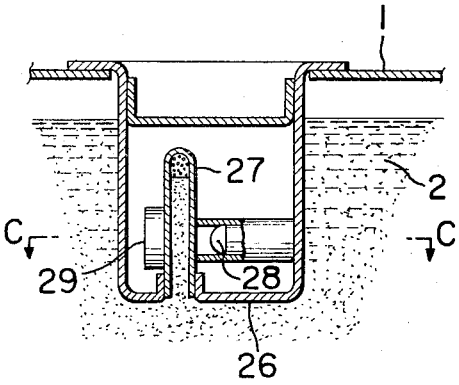
FIG. 4 is a vertical section of an embodiment of the density detector chamber.
Figure 5:
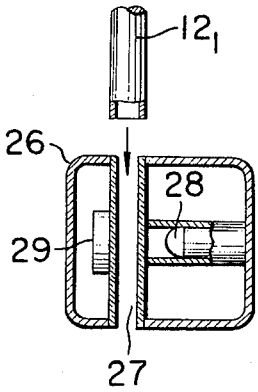
FIG. 5 is a transverse section taken along line C—C in FIG. 4.

FIG. 4 shows, in vertical section, a specific construction of the density detector portion forming part of the density control means in the developing device of the present invention. FIG. 5 is a transverse section taken along line C—C of FIG. 4. A small compartment 26 for detecting the density is defined in the developing liquid 2 contained in the developer container 1, and a passage 27 formed by a transparent material such as glass or the like extends vertically across the compartment 26 so that part of the fluid developing liquid supplied to the developing portion from the pump 4 may be forced into the passage 27 via a conduit $12_1$, as required.

Photoelectric means 28, 29 are disposed on the opposite sides of the passage 27. Even during the inoperative condition of the apparatus, the developing liquid remains in the passage 27 to thereby reduce the possibility of toner adhering to and contaminating the transparent passage wall portion between the lamp 28 and the light receiving element 29. Also, the developing liquid passing through the transparent passage 27 is a sufficiently stirred mixture of carrier liquid and toner delivered to the developing portion, as described previously, and this ensures proper detection of the liquid density.

Figure 6:
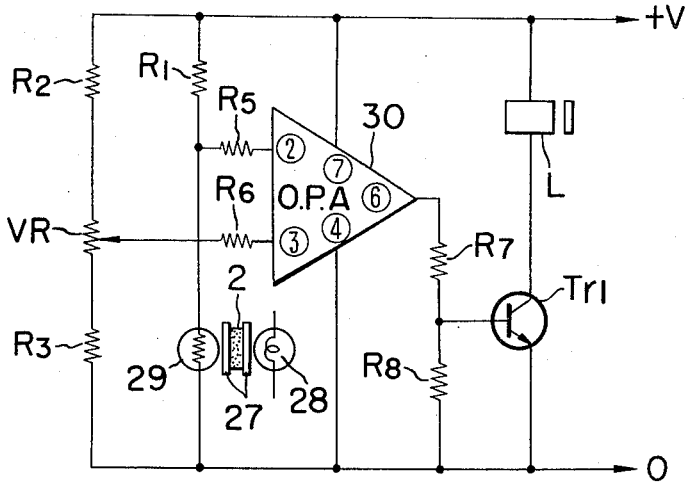
FIG. 6 is a diagram of the electric circuit used in the device of the present invention.

FIG. 6 shows the electric circuit of the density control means used with the present invention. First, for a body of developing liquid preset to a predetermined density, a variable resistor VR is adjusted with respect to the lamp 28 so that the potential set by fixed resistors R2, R3 and variable resistor VR and the potential set by fixed resistor R1 and light receiving element such as CdS cell 29 are completely equal to each other. By so setting, the input terminals (2) and (3) of an operational amplifier (hereinafter referred to as OPA) 30 are at the same potential, so that the output is at zero (low) level to render a transistor T*r*1 non-conductive. In this position, an electromagnetic solenoid L is inoperative and the valve of the toner supply container remains closed. If the density of the developing liquid 2 becomes lower, the quantity of light received by the light receiving element 29 will be increased and the resistance value of this element will be decreased. This will destroy the balance of the bridge to thereby cause the OPA 30 to produce its output which will render the transistor T*r*1 conductive. As a result, the electromagnetic solenoid L will be energized to open the valve of the toner supply container to allow toner to be mixed with the developing liquid so as to restore the predetermined density. When the predetermined density is reached, the bridge including the light receiving element 29 will be balanced to bring about zero output of the OPA 30 again, thus deenergizing the electromagnetic solenoid L to close the valve of the toner supply container.

Figure 7:
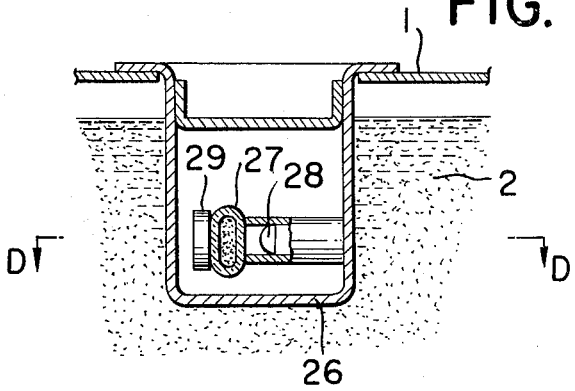
FIG. 7 shows, in vertical section, another embodiment of the density detector chamber.
Figure 8:
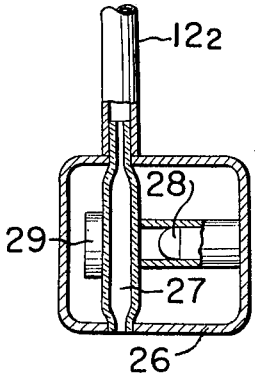
FIG. 8 is a transverse section taken along line D—D in FIG. 7.

FIG. 7 shows another form of the density detector portion in vertical section, and FIG. 8 is a transverse section taken along line D—D of FIG. 7.

The flow of developing liquid may sometimes carry bubbles therein which would cause an error in the density detection.

In the embodiments shown in FIG. 4 or 7, the passage 27 is located far below the liquid level as shown in FIG. 7 or located a little below the liquid level as shown in FIG. 4, so as to permit the bubbles to escape upwardly and thereby prevent any error from occurring in the density detection.

In spite of such designs, contamination by adhering toner would be unavoidable during a long-time use, and especially the density detector portion would suffer from a detection error which leads to a serious inconvenience.

The contamination imparted by toner is primarily attributable to the adhering action of the toner to the transparent member forming the passage. If the immersion of the transparent member in the developing liquid continues for long hours, the adhering action would increase the amount of toner adhering and relatively reduce the transmittivity of the transparent member. Secondly, if the wet transparent member contacts air, toner adhering thereto would be dried up to form layers such as irregular black lateral stripes where the toner is black in appearance. Such black layers would not be soluble even if they were re-immersed in the developing liquid, and repetition of such condition would gradually increase the thickness of the black layers to hamper the transmission of light through the transparent member.

According to the present invention, contamination resulting from the above-described causes may be prevented by using such means as will be described hereunder. A coating of low surface tension material is applied to that side of the liquid density detector portion which is exposed to the developing liquid. When such coating of low surface tension material is contacted by the developing liquid which has a higher surface tension than the coating, there will occur a phenomenon that the mutual wetting between the former material of low surface tension and the latter material of higher surface tension is very much aggravated. By utilizing such phenomenon, it is possible to prevent the toner in the developing liquid from adhering to the transparent member.

Various types of carrier are available for use in the wet development, and most of them have a paraffin molecular structure and generally present a surface tension in the range of about 25 to about 35 dyn/cm. In contrast, materials sufficiently usable to reduce the surface tension of the transparent member below the foregoing range will be enumerated below.

A first material is silicone oil which is a mixture of methyl hydrogen polysiloxane shown by formula (1) below (produced and sold under the tradename of POLON MR by Shinetsu Kagaku Co., Ltd. of Japan) and dimethyl polysiloxane shown by formula (2) below (available from the same manufacturer under the tradename of POLON MG or POLON MN).

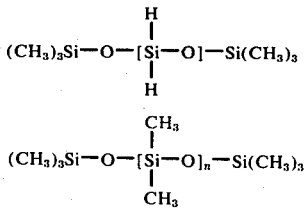

(1)

(2)

Florine materials of low surface tension include: perfluorocarboxylic acid chrome complex salt $[Rf.COOCr_2OH]^{4+}$ ($Rf=CF_3\sim C_4F_9$) (e.g. tradename of FC804, produced by Minnesota Mining and Manufacturing Co.); acrylic acid fluoroalkyester polymer $[-CH_2 - CH(COO\ CH_2R'_f) - ]_n$ ($R'_f=CF_3\sim C_4F_9$) (eg. tradename of SCOTCH GARD, produced by Minnesota Mining and Manufacturing Co.); poly-IH.IH-pentadecafluorooctyl methacrylate (eg. tradename FC706, produced by the same company); and perfluoroalkyester polymer

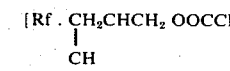

($Rf=C_3F_7\sim C_{10}F_{21}$) (eg. tradename FP-81, produced by Sumitomo Kagaku Co., Ltd.). All these materials are sold in liquidous form. In the embodiment of the present invention, acrylic acid fluoroalkyester polymer has been found more effective than silicone oil materials probably because it has a surface tension of 11 to 15 dyne/cm.

These materials actually present little or no appreciable difference in the physical strength of the formed coating as long as the surface of glass or plastic material forming the transparent member is sufficiently cleaned. Exceptionally, however, some partial wear has been found when the developing liquid has flowed through the transparent member at a very high speed. In practice, such high speed of flow is hardly possible, but a fluorine coating material provided with a reactivity with respect to the glass surface (eg. tradename L-1653 or L-1668 commercially available from Minnesota Mining and Manufacturing Co.) is highly effective against wear, although this material has a surface tension somewhat higher than the aforesaid fluoroalkyester polymer.

It should be noted that a mixture of the above-enumerated various low surface tension materials is also highly effective.

In order that the characteristic of the detector portion using the foregoing materials may be better understood, some examples of our experiments will be shown below.

EXPERIMENT 1

The transparent member was formed of glass or acryl plate, with the detector portion clearance set to 1mm, and the density of the developing liquid was adjusted so that it might transmit 50% of light. Each of the foregoing materials was applied to the surface of the transparent member to form a coating having a thickness of 1 to 6 microns. A different transparent member, formed of the same material but subjected to no such treatment, was continuously immersed in the developing liquid, and the total transmittivity of this member in the developing liquid was measured at each lapse of 1,000 hours, 2,000 hours and 4,000 hours. The results are shown in Table 1 below. The extent of contamination$\Delta T$ imparted to the transparent member by the developing liquid is expressed:$\Delta T=T_o - T_n$, where $T_o$ is the transmittivity at the beginning of the measurement and $T_n$ is that after the lapse of a predetermined time.

Table 1

| Base member | Coating material | Manufacturer | Transmittivity Change: Transmittivity change with time (%) Immersion time (hrs.) 0 | 2000 | 2000 | 3000 |
|---|---|---|---|---|---|---|
| Glass (Blue plate glass) | non-treated | | 50 | 43 | 38 | 20 |
| | Polon MR | Shinetsu Kagaku | 50 | 49 | 47 | — |
| | FC-804 | 3M | 50 | 50 | 49 | 48 |
| | FC-706 | 3M | 50 | 50 | 50 | 50 |
| | Fp-81 | Daikin | 50 | 50 | 50 | 49 |

Table 1-continued

| Base member | Coating material | Manufacturer | Transmittivity Change: Transmittivity change with time (%) Immersion time (hrs.) 0 | 2000 | 2000 | 3000 |
|---|---|---|---|---|---|---|
| | L-1653 | Kogyo 3M | 50 | 49 | 49 | 48 |
| | non-treated | | 50 | 42 | 36 | 19 |
| | Polon MR | Shinatsu Kagaku | 50 | 49 | 47 | 43 |
| Acryl plate (trade-name "Sumipex" | FC-804 | 3M | 50 | 50 | 49 | 47 |
| | FC-706 | 3M | 50 | 50 | 50 | 50 |
| | Fp-81 | Daikin Kogyo | 50 | 50 | 50 | 50 |
| | L-1653 | 3M | 50 | 49 | 48 | 48 |

Note: 3M = Minnesota Mining and Manufacturing Co.

EXPERIMENT 2

The same device as that used in Experiment 1 was used and immersed in the similarly conditioned developing liquid for 8 hours, whereafter it was removed from the liquid and dried for 30 minutes by a drier at 60° C, and then the transmittivity thereof was measured by the use of a spectral photometer. Table 2 below shows the results of the measurements effected at every five, ten, fifteen and twenty cycles, it being understood that the above-described test process is one cycle.

Table 2

| Base member | Coating material | Manufacturer | Transmittivity Change: Transmittivity change with cycle (%) No. of cycles 8 | 5 | 10 | 15 | 20 |
|---|---|---|---|---|---|---|---|
| | non-treated | | 94 | 75 | 54 | 31 | 19 |
| | Polon MR | Shinetsu Kagaku | 90 | 86 | 83 | 83 | 80 |
| Glass (Blue plate glass) | FC-804 | 3M | 92 | 91 | 89 | 89 | 86 |
| | FC-706 | 3M | 92 | 91 | 91 | 91 | 90 |
| | Fp-81 | Daikin Kogyo | 92 | 91 | 90 | 89 | 89 |
| | L-1653 | 3M | 93 | 87 | 87 | 87 | 87 |
| | non-treated | | 96 | 73 | 51 | 32 | 14 |
| Acryl plate (Tradename "Sumipex" | Polon MR | Shinetsu Kagaku | 91 | 86 | 82 | 82 | 82 |
| | FC-804 | 3M | 92 | 91 | 89 | 89 | 89 |
| | FC-706 | 3M | 92 | 91 | 90 | 90 | 90 |
| | Fp-81 | Daikin Kogyo | 92 | 90 | 90 | 90 | 88 |
| | L-1653 | 3M | 93 | 88 | 86 | 86 | 86 |

It can be seen from Experiments 1 and 2 that a great difference in transmittivity is provided between the transparent member having the surface thereof coated with a low surface tension material and the transparent member having no such coating.

However, since toner particles are stirred together with an oil of high insulation resistance to develop the electrostatic latent image on the photosensitive medium, they are provided with electrostatic charges of the opposite polarity to the charges of the electrostatic latent image, due to the friction occurring between the toner particles and the oil. Because of the electrostatic power thus imparted to the toner particles and the adhesive property inherent to the toner particles, some toner particles may also be found to adhere to the surface of the transparent glass or plastic material forming the passage 27 for detecting the density of the developing liquid.

According to the present invention, to prevent the contamination of the transparent member arising from these reasons, either a potential opposite in polarity to the electrostatic latent image to be developed but identical with the toner particles in the developing liquid or an AC voltage may be applied to the transparent member, as desired. The applied voltage acts to repulse toner particles away from the passage portion of the transparent member which provides a light path, thus preventing the toner particles from adhering to such portion.

Figure 9:
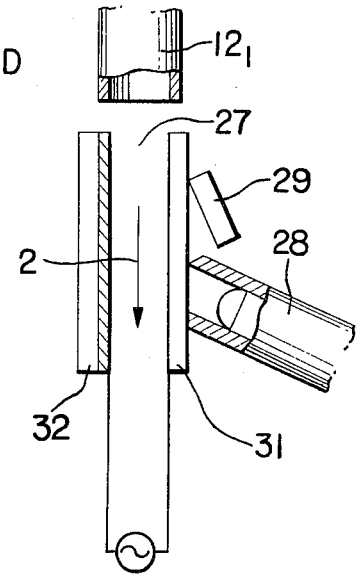
FIG. 9 shows a transparent member in the density detector chamber provided with means for applying an electric field.

FIG. 9 shows a specific embodiment of the detector portion which is provided with the means realizing the above-described prevention of the toner contamination. In this embodiment, both the lamp 28 and the light receiving element 29 are arranged at one side of the passage 27 of the transparent member. That side of the passage 27 which is adjacent to the photoelectric means 28, 29 is provided by a plate of Nesa glass 31 coated with a transparent conductive material such as tin oxide or the like. The other side is provided by a reflector plate 32 having a mirror surface formed of evaorated metal or the like. The developing liquid 2 delivered from the supply means such as pump 4 (FIG. 1) may further be directed into the passage 27 via conduit $\mathbf{12_1}$, as desired.

On the other hand, an AC field or a field of the same polarity as the toner may be applied to or between the Nesa electrode and the metal electrode of the reflector plate, thus preventing the adherence of the toner which would otherwise result from the electrostatic power.

In the embodiment described just above, it is also possible, if desired, to coat the surfaces of the electrodes with a low surface tension material or to dispose the electrodes remote from the developing liquid in the passage while coating the surfaces of the electrodes exposed to the developing liquid with a low surface tension material.

The developing device of the present invention designed in the manner described above is applicable to various types of electrophotographic copying apparatus using the liquid development, and permits the apparatus body to adopt any suitable arrangement. In the case of FIG. 1, a photosensitive drum 14 carrying thereon a photosensitive medium comprising a transparent dielectric layer covering a photosensitive layer is journalled to the apparatus frame 15 by means of a shaft 16 (indicated by a dot-and-dash line), and various means for the formation of electrostatic latent image are arranged peripherally of the drum. Below the drum 14 and closely spaced therefrom is a developing electrode 18 of arcuate cross section for applying a developing bias voltage. The developing liquid 2 is supplied from the outlet port of the pump 4 through pipes 12 and 19 and fully into the clearance between the photosensitive drum 14 and the developing electrode 18. The rest of the developing liquid is collected in the container 1 through the end $\mathbf{18_1}$. Part of the liquid delivered from the pump 4 is supplied as cleaning liquid through pipes 20, 21, 22 into the clearance between the top of the photosensitive drum 14 and a blade cleaner 23. The liquid once used for cleaning flows down along a groove 24 formed peripherally of the drum 14 at either end portion thereof and returns into the container 1. The cleaning blade 23 is supported by a cross bar 25.

As has been described in detail, the developing device of the present invention can always maintain the developing liquid at a uniform and constant density and accordingly can always provide an image reproduction of excellent quality.

Especially, the present invention ensures a satisfactory performance of the apparatus for a very long period of time by providing the density control means to efficiently homogenize the developing liquid and further prevent the reduced performance which would otherwise result from the toner contamination during the long-term use of the apparatus.

We claim:

1. A developing device for developing an electrostatic latent image formed on the surface of an electrostatic image bearing member with a developing liquid having toner particles therein, comprising:

a developing liquid storage tank;

a developing part for contacting said electrostatic image bearing member with developing liquid;

density control means for controlling the density of the developing liquid, said control means including a casing, a developing liquid passage formed across the casing and having a transparent wall, an illumination source disposed adjacent the transparent wall, a light receiving element for receiving the light emitted from the illumination source and passed through the transparent wall, said passage being immersed in developing liquid and being sealed to prevent the developing liquid from leaking into the casing; and means for supplying the developing liquid from said storage tank to said developing part and to said passage of said casing to cause the developing liquid to flow through said passage to prevent toner particles from adhering to said transparent wall.

* * * * *